US007776286B2

(12) United States Patent
Stell et al.

(10) Patent No.: US 7,776,286 B2
(45) Date of Patent: Aug. 17, 2010

(54) PROCESS FOR REDUCING FOULING FROM FLASH/SEPARATION APPARATUS DURING CRACKING OF HYDROCARBON FEEDSTOCKS

(75) Inventors: Richard C. Stell, Houston, TX (US); Nicholas G. Vidonic, Seabrook, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 61 days.

(21) Appl. No.: 12/166,795

(22) Filed: Jul. 2, 2008

(65) Prior Publication Data

US 2008/0274023 A1 Nov. 6, 2008

Related U.S. Application Data

(62) Division of application No. 10/891,981, filed on Jul. 14, 2004, now Pat. No. 7,408,093.

(51) Int. Cl.

| | |
|---|---|
| ***B01J 19/00*** | (2006.01) |
| *B01D 50/00* | (2006.01) |
| *B01J 10/00* | (2006.01) |
| *C07C 4/02* | (2006.01) |
| *C10G 9/00* | (2006.01) |
| *C10G 15/00* | (2006.01) |
| *C10G 9/42* | (2006.01) |
| *C10G 9/14* | (2006.01) |

(52) U.S. Cl. ..... 422/198; 422/177; 422/187; 422/188; 422/189; 422/193; 422/194; 585/648; 208/106; 208/125; 208/132

(58) Field of Classification Search ..... 422/177, 422/187–189, 193, 194, 198, 211; 585/648; 208/106, 125, 130, 132, 347–369

See application file for complete search history.

(56) References Cited

U.S. PATENT DOCUMENTS 2,319,750 A * 5/1943 Schonberg et al. ..... 208/41

(Continued)

FOREIGN PATENT DOCUMENTS

DE 10 93 351 11/1960

(Continued)

OTHER PUBLICATIONS

Dennis A. Duncan and Vance A. Ham, Stone & Webster, "The Practicalities of Steam-Cracking Heavy Oil", Mar. 29-Apr. 2, 1992, A1ChE Spring National Meeting in New Orleans, LA, pp. 1-41.

(Continued)

*Primary Examiner*—Walter D Griffin
*Assistant Examiner*—Natasha Young

(57) ABSTRACT

Hydrocarbon feedstock containing resid is cracked by a process comprising: (a) heating said hydrocarbon feedstock; (b) mixing the heated hydrocarbon feedstock with steam to form a mixture stream; (c) introducing the mixture stream to a flash/separation apparatus to form i) a vapor phase comprising coke precursors existing as uncoalesced condensate, and ii) a liquid phase; (d) removing the vapor phase as overhead and the liquid phase as bottoms from the flash/separation apparatus; (e) treating the overhead by contacting with a condensing means downstream of the flash/separation apparatus to at least partially coalesce the coke precursors to provide residue hydrocarbon liquid, and subsequently removing the hydrocarbon liquid; (f) heating the treated overhead to provide a heated vapor phase (g) cracking the heated vapor phase in a radiant section of a pyrolysis furnace to produce an effluent comprising olefins, the pyrolysis furnace comprising a radiant section and a convection section; and (h) quenching the effluent and recovering cracked product therefrom. An apparatus for carrying out the process is also provided.

16 Claims, 1 Drawing Sheet

U.S. PATENT DOCUMENTS

| | | | | |
|---|---|---|---|---|
| 3,492,795 | A * | 2/1970 | Guerrieri | 55/463 |
| 3,617,493 | A | 11/1971 | Wirth et al. | |
| 3,718,709 | A | 2/1973 | Simonetta | |
| 5,190,634 | A | 3/1993 | Fernandez-Baujin et al. | |
| 5,580,443 | A | 12/1996 | Yoshida et al. | |
| 5,817,226 | A * | 10/1998 | Lenglet | 208/130 |
| 6,376,732 | B1 * | 4/2002 | Ngan et al. | 585/800 |
| 6,632,351 | B1 * | 10/2003 | Ngan et al. | 208/132 |
| 7,138,047 | B2 | 11/2006 | Stell et al. | |
| 7,247,765 | B2 | 7/2007 | Stell et al. | |
| 7,358,413 | B2 | 4/2008 | Stell et al. | |
| 7,641,870 | B2 * | 1/2010 | Stell et al. | 422/198 |
| 2005/0209495 | A1 | 9/2005 | McCoy et al. | |

FOREIGN PATENT DOCUMENTS

| | | |
|---|---|---|
| EP | 0 063 448 | 10/1982 |
| FR | 1472280 | 3/1967 |
| GB | 0 199 766 | 6/1923 |
| GB | 0 998 504 | 7/1965 |
| GB | 1 053 751 | 1/1967 |
| GB | 1 233 795 | 5/1971 |
| GB | 2 006 259 | 10/1977 |
| GB | 2 012 176 | 11/1977 |
| JP | 03-111491 | 5/1991 |
| NL | 7410163 | 4/1975 |
| SU | 1491552 | 7/1989 |
| WO | WO 01/55280 | 8/2001 |
| WO | WO 2004/005431 A1 * | 1/2004 |
| WO | WO 2004/005433 | 1/2004 |
| ZA | 907 394 | 7/1991 |

OTHER PUBLICATIONS

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16.

"Specialty Furnace Design: Steam Reformers and Steam Crackers", presented by T.A. Wells of the M.W. Kellogg Company, 1988 A1ChE Spring National Meeting.

* cited by examiner

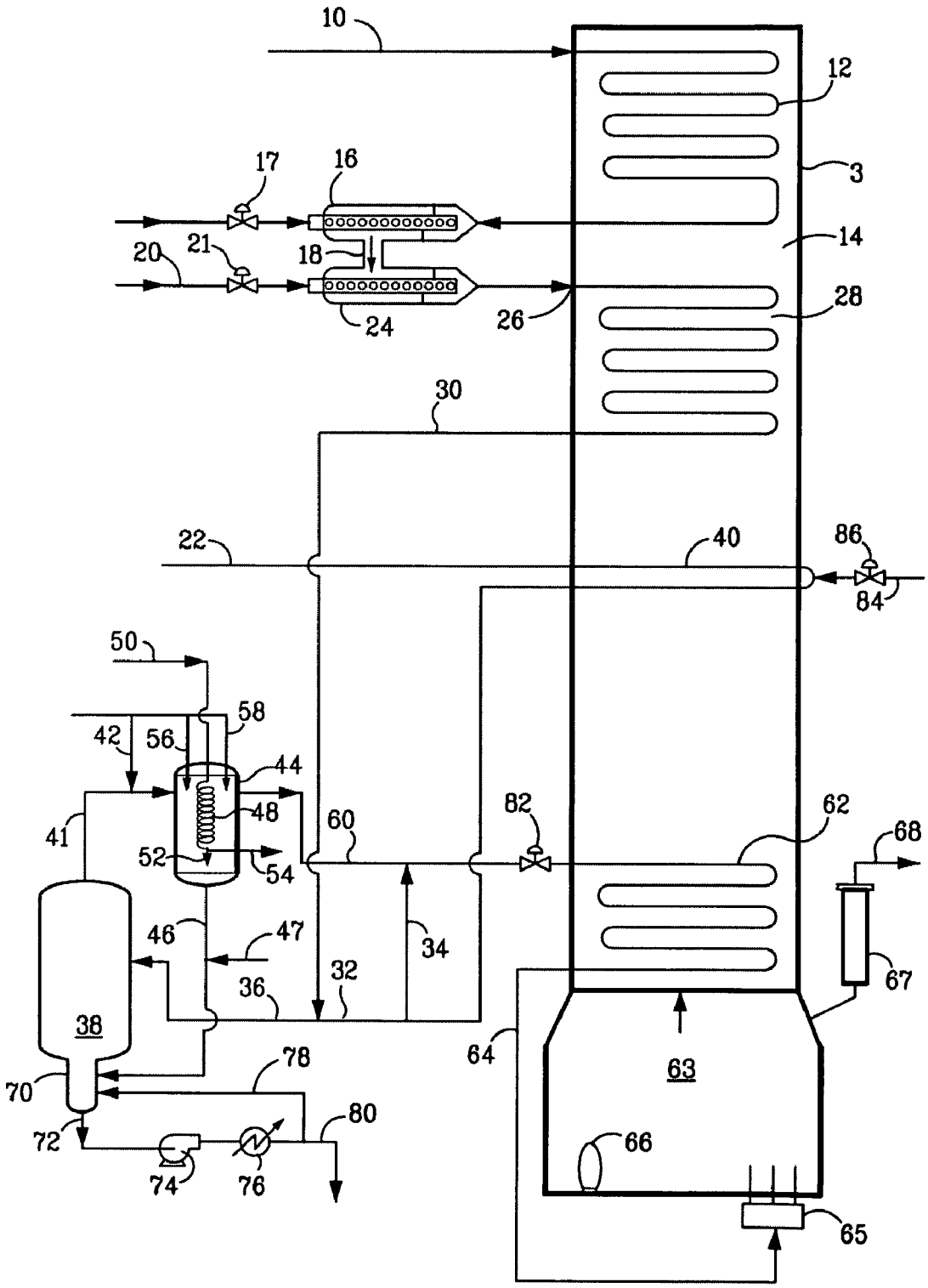
10
12
3
14
17
16
20
21
18
24
26
28
30
22
40
86
84
50
58
42
56
44
41
48
52
54
60
82
62
68
46
47
34
32
36
38
67
64
63
70
78
80
72
74
76
66
65

PROCESS FOR REDUCING FOULING FROM FLASH/SEPARATION APPARATUS DURING CRACKING OF HYDROCARBON FEEDSTOCKS

PRIORITY CLAIM

This non-provisional invention is a divisional of and claims benefit of U.S. Ser. No. 10/891,981, filed Jul. 14, 2004 now U.S. Pat. No. 7,408,093 (allowed).

FIELD OF THE INVENTION

The present invention relates to the cracking of hydrocarbons that contain relatively non-volatile hydrocarbons and other contaminants.

BACKGROUND OF THE INVENTION

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products including olefins leave the pyrolysis furnace for further downstream processing, including quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil and atmospheric residue. Crude oil and atmospheric residue often contain high molecular weight, non-volatile components with boiling points in excess of 1100° F. (590° C.) otherwise known as resids. The non-volatile components of these feedstocks lay down as coke in the convection section of conventional pyrolysis furnaces. Only very low levels of non-volatile components can be tolerated in the convection section downstream of the point where the lighter components have fully vaporized.

Additionally, during transport some naphthas are contaminated with heavy crude oil containing non-volatile components. Conventional pyrolysis furnaces do not have the flexibility to process residues, crudes, or many residue or crude contaminated gas oils or naphthas which are contaminated with non-volatile components.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are cracked. Periodic regeneration above pyrolysis temperature is effected with air and steam.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

Co-pending U.S. application Ser. No. 10/188,461 filed Jul. 3, 2002, U.S. Pat. No. 7,138,047, issued Nov. 21, 2006, which is incorporated herein by reference, describes an advantageously controlled process to optimize the cracking of volatile hydrocarbons contained in the heavy hydrocarbon feedstocks and to reduce and avoid coking problems. It provides a method to maintain a relatively constant ratio of vapor to liquid leaving the flash by maintaining a relatively constant temperature of the stream entering the flash. More specifically, the constant temperature of the flash stream is maintained by automatically adjusting the amount of a fluid stream mixed with the heavy hydrocarbon feedstock prior to the flash. The fluid can be water.

Co-pending U.S. patent application Ser. No. 11/068,615, filed Feb. 28, 2005, Patent Publication No. 2005-0209495, published Sep. 22, 2005, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

Co-pending U.S. patent application Ser. No. 10/851,494, filed May 21, 2004, U.S. Pat. No. 7,247,765, issued Jul. 24, 2007, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. Fouling downstream of the flash/separation vessel is reduced by partially condensing the vapor in the upper portion of the vessel, e.g., by cooling tubes within the vessel, thus separating the resid containing condensate from the vapor phase.

Co-pending U.S. patent application Ser. No. 10/891,795, filed Jul. 14, 2004, U.S. Pat. No. 7,358,413, issued Apr. 15, 2008, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. Fouling downstream of the flash/separation vessel is reduced by contacting flash/separation vessel overhead with a nucleating hydrocarbon to at least partially coalesce coke precursors to provide residue hydrocarbon droplets which are collected and removed before further processing of the overhead.

In using a flash to separate heavy liquid hydrocarbon fractions containing resid from the lighter fractions which can be processed in the pyrolysis furnace, it is important to effect the separation so that most of the non-volatile components will be in the liquid phase. Otherwise, heavy, coke-forming non-volatile components in the vapor are carried into the furnace causing coking problems.

Increasing the cut in the flash drum, or the fraction of the hydrocarbon that vaporizes, is also extremely desirable because resid-containing liquid hydrocarbon fractions generally have a low value, often less than heavy fuel oil. Vaporizing more of the lighter fractions produces more valuable steam cracker feed. Although this can be accomplished by increasing the flash drum temperature to increase the cut, the resulting heavier fractions thus vaporized tend to condense due to heat losses and endothermic cracking reactions once the overhead vapor phase leaves the flash drum, resulting in fouling of the lines and vessels downstream of the flash drum overhead outlet.

Accordingly, it would be desirable to provide a process for treating vapor phase materials immediately downstream of a flash drum to remove components which are susceptible to condensing downstream of the drum overhead outlet.

SUMMARY OF THE INVENTION

In one aspect, the present invention relates to a process for cracking a hydrocarbon feedstock containing resid, the process comprising: (a) heating the hydrocarbon feedstock; (b) mixing the heated hydrocarbon feedstock with steam and optionally water to form a mixture stream; (c) introducing the mixture stream to a flash/separation apparatus to form i) a vapor phase which subsequently partially cracks and/or loses heat causing partial condensation of the vapor phase to provide coke precursors existing as uncoalesced condensate, and ii) a liquid phase; (d) removing the vapor phase with uncoalesced condensate as overhead, and the liquid phase as bottoms from the flash/separation apparatus; (e) treating the overhead by contacting with a condensing means downstream of the flash/separation apparatus to at least partially coalesce the coke precursors to provide residue hydrocarbon liquid, and subsequently collecting and removing the liquid; (f) heating the treated overhead to provide a heated vapor phase; (g) cracking the heated vapor phase in a pyrolysis furnace to produce an effluent comprising olefins; and (h) quenching the effluent and recovering cracked product therefrom.

In another aspect, the present invention relates to an apparatus for cracking a hydrocarbon feedstock containing resid. The apparatus comprises: (1) a convection heater for heating the hydrocarbon feedstock; (2) an inlet for introducing steam and optionally water to the heated hydrocarbon feedstock to form a mixture stream; (3) a flash/separation drum for treating the mixture stream to form i) a vapor phase which partially cracks and/or loses heat causing partial condensation of the vapor phase to provide uncoalesced supersaturated coke precursors (residue hydrocarbons) as entrained liquid, and ii) a liquid phase; the drum further comprising a flash/separation drum overhead outlet for removing the vapor phase as overhead and a flash/separation drum liquid outlet for removing the liquid phase as bottoms from the flash/separation drum; (4) a condenser for treating the overhead downstream of the flash/separation apparatus by at least partially coalescing the supersaturated coke precursors to provide liquid which can further coalesce with additional uncoalesced coke precursors to provide additional coalesced supersaturated coke precursors; (5) a collecting means for collecting the liquid and the additional coalesced coke precursors; (6) a convection heater for heating the treated overhead to provide a heated vapor phase; (7) a pyrolysis furnace comprising a radiant section for cracking the heated vapor phase to produce an effluent comprising olefins; and (8) a means for quenching the effluent and recovering cracked product therefrom.

BRIEF DESCRIPTION OF THE DRAWING

FIG. 1 illustrates a schematic flow diagram of the overall process and apparatus in accordance with the present invention employed with a pyrolysis furnace.

DETAILED DESCRIPTION

When heavy resid containing hydrocarbon feeds are used, the feed is preheated in the upper convection section of a pyrolysis furnace, mixed with steam and optionally, water, and then further preheated in the convection section, where the majority of the hydrocarbon vaporizes, but not the resid. This two-phase mist flow stream may pass through a series of pipe bends, reducers, and piping that convert the two-phase mist flow to two-phase stratified open channel flow, i.e., the liquid flows primarily through the bottom cross-section of the pipe and the vapor phase flows primarily though the remaining upper cross-section of the pipe. The stratified open channel flow is introduced through a tangential inlet to a flash/separation apparatus, e.g., a knockout drum, where the vapor and liquid separate. The vapor phase is initially at its dew point and becomes supersaturated with coke precursors. Coke precursors are large hydrocarbon molecules that condense into a viscous liquid which forms coke under conditions present in the convection section. Supersaturation may exist when a homogeneous nucleation constant, $S_{crit}$, relating to condensing in the absence of added seed particles, is lower than a value ranging from about 1.4 to about 2.6. Preferably, the vapor phase has a homogeneous nucleation parameter, S, which is less than about 1.4, e.g., ranging from about 0.0034 to about 0.016. See, e.g., Theory of Fog Condensation by A. G. Amelin (1966). In one embodiment, the vapor phase contains at least trace amounts of coke precursor liquid.

The vapor phase is hot enough to crack reducing the vapor temperature by as much as 28° C. (50° F.), say, e.g., by about 8° C. (15° F.) before it is further preheated in the lower convection section and then cracked in the radiant section of the furnace. This cooling effect condenses a portion of the heaviest hydrocarbon in the vapor phase: The cooling effect results in partial condensation of the vapor phase. The condensate dehydrogenates and/or polymerizes into foulant that limits both the time between decoking treatments and the maximum amount of hydrocarbon present as vapor in the flash/separation apparatus. Microscopic analysis of the foulant indicates it is derived from liquid hydrocarbon.

The foulant including coke precursors typically exists as an uncoalesced condensate which is difficult to separate out. While a liquid, the uncoalesced condensate exists in particles which are too small to effectively fall out of the vapor before it passes out of the flash/separation apparatus as overhead, unless treated. Such uncoalesced condensate comprises particles of less than about ten microns in their largest dimension, typically, particles of less than about one micron in their largest dimension.

The present invention utilizes a condensing means to effect at least partial removal of uncoalesced condensate/entrained liquid. The condensing means acts as a nucleating cooler which cools and coalesces uncoalesced liquids in overhead vapor from a flash/separation vessel. Overhead vapor containing liquids is contacted with a cooled surface. Such a condenser is located downstream of the flash/separation vessel, preferably upstream of or within a centrifugal separator placed downstream of the flash/separation vessel overhead outlet. The condensing means comprises a vapor/liquid contacting surface which is maintained under conditions sufficient to effect condensation and coalescing of condensable fractions within the vapor phase. Once condensed and coalesced the liquid (e.g. drops) are seeds that coalesce additional supersaturated coke precursors.

In one embodiment, the condensing means comprises a heat-conducting tube containing a cooling or heat exchange medium, e.g., water or steam. The tube can be made of any heat conducting material, e.g., metal, which complies with local boiler and piping codes. A cooling medium is present within the tube, e.g., a fluid such as a liquid or gas. In one embodiment, the cooling medium comprises liquid, typically, water, e.g., boiler feed water. The cooling tube typically comprises a tube inlet and a tube outlet for introducing and removing the cooling medium. The tube can be straight or arranged as a coil, typically where the coil comprises more than about one loop, say, from about 2 to about 20 loops. In an embodiment which utilizes a centrifugal separator, the heat exchange medium can be exhausted from the cooling tube within the centrifugal separator itself. Alternatively, or supplementally, the heat exchange medium can be exhausted to the outside of the centrifugal separator from the cooling tube.

In operation of a preferred embodiment, the cooling or condenser tube typically has an outside tube metal temperature (TMT) ranging from about 200 to about 370° C. (400 to 700° F.), say, from about 260 to about 315° C. (500 to 600° F.). At this temperature, a large amount of heavy hydrocarbon condensation occurs on the outside of the cooling tubes but not in the centrifugal separator cross-sectional area between the tubes, producing a partial coalescing effect. The tube may be of any size sufficient to remove the requisite heat to the vapor phase. In a preferred embodiment, the tube has a diameter of about 5 to 10 cm (2 to 4 in). For a vessel of about 1 m (4 feet) diameter, the condenser heat duty typically ranges from about 0.06 to about 0.60 MW (0.2 to 2 MBtu/hr) or from about 0.06 to about 0.6% of firing, say, from about 0.1 to about 0.3 MW (0.4 to 1 MBtu/hr) or from about 0.1 to about 0.3% of firing. In one embodiment, boiler feed water is passed through the condenser at a rate of about 450 to about 13,000 kg/hr (1 to 30 klb/hr) at a temperature ranging from about 100 to about 260° C. (212 to 500° F.), at a pressure ranging from about 350 to about 17,000 kPag (50 to 2500 psig). In a preferred embodiment, the surface temperature of the tube is at least about 50° C. (90° F.) cooler, say, from about 200 to about 400° C. (360 to 720° F.) cooler, than the initial temperature of the separator drum overhead vapor during the contacting. The condensing means preferably utilizes no greater than about 1 MW (3 MBtu/hr) of cooling per 45,000 kg/hr (100,000 lbs/hr) of overhead, e.g., no greater than about 0.2 MW (0.6 MBtu/hr) of cooling per 45,000 kg/hr (100,000 lbs/hr) of overhead.

At least about 50 wt %, e.g., at least about 75 wt %, of the coke precursors are at least partially coalesced by the treating with the condenser and removed as the droplets or a continuous liquid phase. The collected droplets can be recycled to the flash/separation apparatus.

In a preferred embodiment, the condensing means will utilize no greater than about 1 MW (3 MBtu/hr) of cooling per 45,000 kg/hr (100,000 lbs/hr) of overhead. In another embodiment, the condensing means will utilizes no greater than about 0.2 MW (0.6 MBtu/hr) of cooling per 45,000 kg/hr (100,000 lbs/hr) of overhead It has been found useful in some instances to further remove the coke precursor liquid present in the overhead from the flash/separation by means of a centrifugal separator. The centrifugal separator typically comprises a cylinder having an upper portion and a lower portion, with the upper portion having an upper vapor inlet with deflectors which impart a downward swirling motion to the vapor, and an upper vapor outlet, and the lower portion having a lower liquid outlet for removing the coke precursor liquid. In one embodiment of the invention, the condensing means is located in the upper portion of the centrifugal separator which further condenses and coalesces the overhead. Typically, the contacting is carried out in the upper portion of the centrifugal separator. The coalesced coke precursor droplets can be removed through the lower liquid outlet.

In a preferred embodiment, the condensing means fits within the upper portion of the centrifugal separator vessel; thus the condensing means is preferably substantially planar and configured so it can be horizontally mounted within the vessel. In one embodiment, the tube present in the condensing means is continuous and comprised of alternating straight sections and 180° bend sections beginning with a straight inlet section and terminating in a straight outlet section. Cooling medium which is cooler than the vapor phase temperature is introduced via the inlet section and, after heat exchange with the vapor, heated cooling medium is withdrawn through the outlet section. Alternatively, the condensing means can be in the form of a coil, e.g., a helical tube or a spiral tube or any other means to effect at least partial coalescing of uncoalesced condensate/entrained liquid.

The mixture stream is typically introduced to the flash/separation vessel through an inlet in the side of the flash/separation vessel. The inlet can be substantially perpendicular to the vessel wall, or more advantageously, angled so as to be at least partially tangential to the vessel wall in order to effect swirling of the mixture stream feed within the vessel.

The coke precursor liquid can be taken via a line as effluent from the lower liquid outlet of the centrifugal separator to the flash/separation apparatus for further separation. A quenching and fluxing additive can also be introduced to the effluent from the lower liquid outlet prior to introducing the effluent to the flash/separation apparatus, e.g., via a line which introduces quenching and fluxing additive to the effluent from the centrifugal separator at a point between the lower liquid outlet of the separator and the inlet to the flash/separation apparatus, e.g., at the boot or lower portion of the flash/separation apparatus. The quenching and fluxing additive can be any suitable material, for example, one which is selected from the group consisting of steam cracker gas oil, quench oil, and cycle oil. The quenching and fluxing additive is typically introduced to the effluent at a temperature no greater than about 260° C. (500° F.). Preferably, the quenching and fluxing additive can be steam cracker gas oil introduced to the effluent at a temperature of about 140° C. (280° F.).

In one embodiment, the present invention further treats the overhead containing uncoalesced condensate downstream of the flash/liquid separation apparatus by contacting with a nucleating liquid in order to effect coalescing of the uncoalesced condensate and enable substantial removal of the resid foulant. Suitable nucleating liquid for use in the present invention comprises components boiling at a temperature of at least about 260° C. (500° F.), typically, at least about 450° C. (840° F.). Preferably, such temperature is below about 600° C. (1110° F.). Such nucleating liquid can be obtained from various sources known to those of skill in the art. Typically, nucleating liquid is selected from vacuum gas oil and deasphalted vacuum resid, with vacuum gas oil being a preferred nucleating liquid.

Nucleating liquid is typically at a temperature below about 260° C. (500° F.), e.g., a temperature ranging from about 100 to about 260° C. (212 to 500° F.), when contacted with the vapor phase overhead. It has been found beneficial to introduce the nucleating liquid in a form which optimizes its contacting with the overhead vapor phase. Such forms include a spray, which provides drops typically ranging from about 100 to about 10,000 microns. Suitable devices for introducing the nucleating liquid in a form which optimizes its contact with the overhead vapor phase include nozzles as known to those of skill in the art. In a preferred embodiment, the nozzle (or nozzles) is preferably located downstream of the overhead outlet of the flash/separation apparatus. Where a centrifugal separator is employed downstream of the overhead outlet of the flash/separation apparatus, the nozzle(s) can be placed upstream of the centrifugal separator, or alternately or supplementally, within the centrifugal separator itself. Such nozzle(s) can be located within the upper portion of the centrifugal separator, or located adjacent the upper vapor inlet, and/or located adjacent the upper vapor outlet.

In one embodiment, the bottoms taken from the flash/separation apparatus are cooled and then recycled as quench to the flash/separation apparatus. The apparatus may thus comprise a line from the flash/separation drum liquid outlet through a heat exchanger and back to the flash/separation drum. Alternately, or additionally, the bottoms from the flash/separation apparatus can be utilized as fuel. The apparatus may thus comprise a line from the flash/separation drum liquid outlet through a heat exchanger to a fuel collection vessel.

In applying this invention, the hydrocarbon feedstock containing resid and coke precursors may be heated by indirect contact with flue gas in a first convection section tube bank of the pyrolysis furnace before mixing with the fluid. Preferably, the temperature of the hydrocarbon feedstock is from about 150° C. to about 260° C. (300° F. to 500° F.) before mixing with the fluid.

The mixture stream may then be heated by indirect contact with flue gas in a first convection section of the pyrolysis furnace before being flashed. Preferably, the first convection section is arranged to add the primary dilution steam, and optionally, a fluid, between passes of that section such that the hydrocarbon feedstock can be heated before mixing with the fluid and the mixture stream can be further heated before being flashed.

The temperature of the flue gas entering the first convection section tube bank is generally less than about 815° C. (1500° F.), for example, less than about 700° C. (1300° F.), such as less than about 620° C. (1150° F.), and preferably less than about 540° C. (1000° F.).

Dilution steam may be added at any point in the process, for example, it may be added to the hydrocarbon feedstock containing resid before or after heating, to the mixture stream, and/or to the vapor phase. Any dilution steam stream may comprise sour steam, process steam, and/or clean steam. Any dilution steam stream may be heated or superheated in a convection section tube bank located anywhere within the convection section of the furnace, preferably in the first or second tube bank.

The mixture stream may be at about 315 to about 540° C. (600° F. to 1000° F.) before the flash in step (c), and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. By "trace amounts" is meant less than 1 wt % of the hydrocarbon in the overhead. The vapor phase may be heated above the flash temperature before entering the radiant section of the furnace, for example, from about 425 to about 705° C. (800 to 1300° F.). This heating may occur in a convection section tube bank, preferably the tube bank nearest the radiant section of the furnace.

Unless otherwise stated, all percentages, parts, ratios, etc. are by weight. Moreover, unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed.

As used herein, non-volatile components, or resids, are the fraction of the hydrocarbon feed with a nominal boiling point above about 590° C. (1100° F.) as measured by ASTM D-6352-98 or D-2887. This invention works very well with non-volatiles having a nominal boiling point above about 760° C. (1400° F.). The boiling point distribution of the hydrocarbon feed is measured by Gas Chromatograph Distillation (GCD) by ASTM D-6352-98 or D-2887. Non-volatiles include coke precursors, which are large, condensable molecules that condense in the vapor, and then form coke under the operating conditions encountered in the present process of the invention.

The hydrocarbon feedstock can comprise a large portion, such as about 2 to about 50%, of non-volatile components. Such feedstock could comprise, by way of non-limiting examples, one or more of steam cracked gas oil and residues, gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, natural gasoline, distillate, virgin naphtha, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, hydrocarbon gases/residue admixtures, hydrogen/residue admixtures, C4's/residue admixture, naphtha/residue admixture, gas oil/residue admixture, and crude oil.

The hydrocarbon feedstock can have a nominal end boiling point of at least about 315° C. (600° F.), generally greater than about 510° C. (950° F.), typically greater than about 590° C. (1100° F.), for example, greater than about 760° C. (1400° F.). The economically preferred feedstocks are generally low sulfur waxy residues, atmospheric residues, naphthas contaminated with crude, various residue admixtures, and crude oils.

The heating of the hydrocarbon feedstock containing resid can take any form known by those of ordinary skill in the art. However, as seen in FIG. 1, it is preferred that the heating comprises indirect contact of the hydrocarbon feedstock 10 in the upper (preferably farthest from the radiant section) convection section tube bank of heat exchange tubes 12 of the furnace 14 with hot flue gases from the radiant section 63 of the furnace. The heated hydrocarbon feedstock typically has a temperature between about 150 and about 260° C. (300 to 500° F.), such as between about 160 to about 230° C. (325 to 450° F.), for example, between about 170 to about 220° C. (340 to 425° F.).

The heated hydrocarbon feedstock is mixed with primary dilution steam and optionally, a fluid that can be a hydrocarbon (preferably liquid but optionally vapor), water, steam, or a mixture thereof. The preferred fluid is water. A source of the fluid can be low-pressure boiler feed water. The temperature of the fluid can be below, equal to, or above the temperature of the heated feedstock.

The mixing of the heated hydrocarbon feedstock and the fluid can occur inside or outside the pyrolysis furnace 14, but preferably it occurs outside the furnace. The mixing can be accomplished using any mixing device known within the art. For example, it is possible to use a first sparger 16 controlled by valve 17 of a double sparger assembly 18 for the mixing. The first sparger 16 can avoid or reduce hammering, caused by sudden vaporization of the fluid, upon introduction of the fluid into the heated hydrocarbon feedstock.

In a preferred embodiment, the present invention uses steam streams in various parts of the process. The primary dilution steam stream 20 controlled by valve 21 can be mixed with the heated hydrocarbon feedstock as detailed below. In another embodiment, a secondary dilution steam stream 22 can be heated in the convection section and mixed with the heated mixture steam before the flash. The source of the secondary dilution steam may be primary dilution steam that has been superheated, optionally, in a convection section of the pyrolysis furnace. Either or both of the primary and secondary dilution steam streams may comprise sour or process steam. Superheating the sour or process dilution steam minimizes the risk of corrosion, which could result from condensation of sour or process steam.

In one embodiment of the present invention, in addition to the fluid mixed with the heated feedstock, the primary dilution steam 20 is also mixed with the feedstock. The primary dilution steam stream can be preferably injected into a second sparger 24. It is preferred that the primary dilution steam stream is injected into the hydrocarbon fluid mixture before the resulting stream mixture optionally enters the convection section at 26 for additional heating by flue gas, generally within the same tube bank as would have been used for heating the hydrocarbon feedstock.

The primary dilution steam can have a temperature greater, lower or about the same as hydrocarbon feedstock fluid mixture but preferably the temperature is about the same as the mixture, yet serves to partially vaporize the feedstock/fluid mixture. The primary dilution steam may be superheated before being injected into the second sparger 24.

The mixture stream comprising the heated hydrocarbon feedstock, the fluid, and the primary dilution steam stream leaving the second sparger 24 is optionally heated again in the convection section 3 of the pyrolysis furnace 14 before the flash. The heating can be accomplished, by way of non-limiting example, by passing the mixture stream through a bank of heat exchange tubes 28 located within the convection section, usually as part of the first convection section tube bank, of the furnace and thus heated by the hot flue gas from the radiant section 63 of the furnace. The thus-heated mixture stream leaves the convection section as a mixture stream 30 optionally to be further mixed with an additional steam stream.

Optionally, the secondary dilution steam stream 22 can be further split into a flash steam stream 32 which is mixed with the hydrocarbon mixture 30 before the flash and a bypass steam stream 34 (which may be superheated steam) which bypasses the flash of the hydrocarbon mixture and, instead is mixed with the vapor phase from the flash before the vapor phase is cracked in the radiant section of the furnace. The present invention can operate with all secondary dilution steam 22 used as flash steam 32 with no bypass steam 34. Alternatively, the present invention can be operated with secondary dilution steam 22 directed to bypass steam 34 with no flash steam 32. In a preferred embodiment in accordance with the present invention, the ratio of the flash steam stream 32 to bypass steam stream 34 should be preferably 1:20 to 20:1, and most preferably 1:2 to 2:1. In this embodiment, the flash steam 32 is mixed with the hydrocarbon mixture stream 30 to form a flash stream 36, which typically is introduced before the flash/separation vessel 38. Thus, the apparatus of the invention can comprise a line for introducing superheated steam at a point downstream of the nozzle(s) for introducing nucleating hydrocarbons, and upstream of the lower convection heater, i.e., convection section tube bank 62. Preferably, the secondary dilution steam stream is superheated in a superheater section 40 in the furnace convection before splitting and mixing with the hydrocarbon mixture. The addition of the flash steam stream 32 to the hydrocarbon mixture stream 30 aids the vaporization of most volatile components of the mixture before the flash stream 36 enters the flash/separator vessel 38.

The mixture stream 30 or the flash stream 36 is then introduced for flashing, either directly or through a tangential inlet (to impart swirl) to a flash/separation apparatus, e.g., flash/separator vessel 38, for separation into two phases: a vapor phase comprising predominantly volatile hydrocarbons and steam and a liquid phase comprising predominantly non-volatile hydrocarbons. The vapor phase is preferably removed from the flash/separator vessel as an overhead vapor stream 41.

The overhead vapor stream 41, which contains entrained liquid or supersaturated vapor such as coke precursor phase is optionally treated with a hydrocarbon-containing nucleating liquid substantially free of resid and comprising components boiling at a temperature of at least about 260° C. (500° F.) under conditions sufficient to at least partially coalesce coke precursor hydrocarbons to provide hydrocarbon droplets. The nucleating liquid can thus be introduced via line 42 to 41 as it leaves the flash/separator vessel. Certain embodiments employ a centrifugal separator 44 in which entrained liquid-containing vapor overhead is deflected in a centrifugal downward motion to separate out entrained liquid by centrifugal forces which liquid is removed via line 46. A direct quench such as steam cracker gas oil, which can be introduced at about 140° C. (280° F.), can be added to the bottoms via line 47. A condenser means, e.g., a cooling tube 48, can advantageously be positioned within the centrifugal separator. The cooling tube can utilize cooling medium such as steam or water introduced via line 50, which cooling medium can be discharged within the centrifugal separator via outlet 52 and/or outside the separator via line 54. Optionally, in those embodiments employing the centrifugal separator, the nucleating liquid can be introduced within the centrifugal separator 38 via line 56 adjacent the centrifugal separator inlet and/or via line 58 adjacent the centrifugal separator outlet for removing overhead via line 60. Preferably, the optional nucleating liquid is introduced as a mist or spray through a nozzle in order to optimize its exposure to the entrained liquid in the overhead with which it coalesces to form droplets or a continuous liquid phase which are removed via line 46. Preferably, at least about 50 wt %, e.g., at least about 75 wt %, of the coke precursors are coalesced by such treating and are thus removed as droplets or a continuous liquid phase.

The treated overhead from which entrained liquid has been substantially removed is fed back to a convection section tube bank 62 of the furnace, preferably located nearest the radiant section of the furnace 63, for optional heating and through crossover pipes 64 via manifold 65 to the radiant section utilizing burners 66 of the pyrolysis furnace for cracking, which provides cracked products which are directed to transfer line exchanger 67 (or direct quench by quench oil or water), from which cooled olefins are recovered via line 68. The liquid phase of the flashed mixture stream is removed from the boot 70 of flash/separator vessel 38 as a bottoms stream 72 which can be transferred via pump 74 and cooled via heat exchanger 76 and recycled to the flash/separator vessel via line 78 and/or drawn off for use as fuel via line 80.

Preferably, the hydrocarbon partial pressure of the flash stream of line 36 in the present invention is set and controlled at between about 25 and about 175 kPa (4 and about 25 psia), such as between about 35 and about 100 kPa (5 and 15 psia), for example, between about 40 and about 75 kPa (6 and 11 psia).

The flash is conducted in at least one flash/separator vessel 38. Typically, the flash is a one-stage process with or without reflux. The flash/separator vessel is normally operated at about 275 to 1400 kPa (40 to 200 psia) pressure and its temperature is usually the same or slightly lower than the temperature of the flash stream 36 at the flash/separation apparatus feed inlet before entering the flash/separator vessel. Preferably, the pressure at which the flash/separator vessel operates is at about 275 to about 1400 kPa (40 to 200 psia). For example, the pressure of the flash can be from about 600 to about 1100 kPa (85 to 160 psia). As a further example, the pressure of the flash can be about 700 to about 1000 kPa (100 to 145 psia). In yet another example, the pressure of the flash/separator vessel can be about 700 to about 860 kPa (100 to 125 psia). Preferably, the temperature is at about 310 to about 540° C. (600 to 1000° F.), preferably, about 370 to about 490° C. (700 to 920° F.), say, about 400 to about 480° C. (750 to 900° F.), e.g., the temperature can be about 430 to about 475° C. (810 to 890° F.). Depending on the temperature of the mixture stream 30, generally about 50 to about 98% of the mixture stream being flashed is in the vapor phase, such as about 60 to about 95%, for example, about 65 to about 90%.

Preferably, the vapor phase throughput for the flash/separation apparatus ranges from about 9,000 to about 90,000 kg/hour (20,000 to 200,000 pounds/hour) steam, from about 25,000 to about 80,000 kg/hour (55,000 to 180,000 pounds/hour) hydrocarbons, e.g., the vapor phase throughput for the flash/separation apparatus can be about 15,000 kg/hour (33,000 pounds/hour) steam, and about 33,000 kg/hour (73,000 pounds/hour) hydrocarbons.

The flash/separator vessel 38 is generally operated, in one aspect, to minimize the temperature of the liquid phase at the bottom of the vessel because too high a temperature may cause coking of the non-volatiles in the liquid phase. Use of the secondary dilution steam stream 22 in the flash stream entering the flash/separator vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separator vessel bottoms liquid 78 back to the flash/separator vessel to help cool the newly separated liquid phase at the bottom of the flash/separator vessel 38. Stream 72 can be conveyed from the bottom of the flash/separator vessel 38 to the cooler 76 via pump 74. The cooled stream can then be split into a recycle stream 78 and export stream 80, for, say, fuels. The temperature of the recycled stream would typically be about 260 to about 315° C. (500 to 600° F.), for example, about 270 to about 290° C. (520 to 550° F.). The amount of recycled stream can be from about 80 to about 250% of the amount of the newly separated bottom liquid inside the flash/separator vessel, such as from about 90 to about 225%, for example, from about 100 to about 200%.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. An apparatus for cracking a hydrocarbon feedstock containing resid, said apparatus comprising:

(1) a convection heater for heating said hydrocarbon feedstock;

(2) an inlet for introducing steam and optionally water to said heated hydrocarbon feedstock to form a mixture stream;

(3) a flash/separation drum for treating said mixture stream to form i) a vapor phase which partially cracks and/or loses heat causing partial condensation of said vapor phase to provide uncoalesced supersaturated coke precursors as entrained liquid, and ii) a liquid phase; said drum further comprising a flash/separation drum overhead outlet for removing the vapor phase as overhead and a flash/separation drum liquid outlet for removing said liquid phase as bottoms from said flash/separation drum;

(4) a centrifugal separator for at least partially removing said entrained liquid from said overhead downstream of said flash/separation drum, with a condensing means located within said centrifugal separator that includes a condenser for treating said overhead downstream of said flash/separation apparatus by at least partially coalescing said supersaturated coke precursors to provide liquid which can further coalesce with additional uncoalesced supersaturated coke precursors to provide additional coalesced coke precursors;

(5) a collecting means comprising a liquid outlet line from the centrifugal separator for collecting said liquid and said additional coalesced coke precursors;

(6) a convection heater for heating said treated overhead to provide a heated vapor phase;

(7) a pyrolysis furnace comprising a radiant section for cracking the heated vapor phase to produce an effluent comprising olefins; and (8) a means for quenching the effluent and recovering cracked product therefrom.

2. The apparatus of claim 1 which further comprises at least one tangential inlet for introducing said mixture stream through a side of said flash/separation drum.

3. The apparatus of claim 1 wherein said centrifugal separator comprises a cylinder comprising an upper portion and a lower portion, said upper portion having an upper vapor inlet with deflectors which impart a downward swirling motion to incoming vapor, and an upper vapor outlet, and said lower portion having a lower liquid outlet for removing said entrained liquid.

4. The apparatus of claim 3 wherein said condensing means comprises a cooling tube.

5. The apparatus of claim 4 wherein said condensing means is located in said upper portion of said centrifugal separator.

6. The apparatus of claim 5 wherein said condensing means comprises a cooling tube which can contain a heat exchange medium.

7. The apparatus of claim 6 wherein said heat exchange medium is selected from the group consisting of water and steam.

8. The apparatus of claim 6 wherein said tube is straight.

9. The apparatus of claim 6 wherein said tube is arranged as a coil.

10. The apparatus of claim 9 wherein said coil comprises more than about one loop.

11. The apparatus of claim 10 wherein said coil comprises from about 2 to about 20 loops.

12. The apparatus of claim 1 which further comprises an inlet for adding superheated steam to said overhead downstream of said condenser coil and upstream of said convection heater.

13. The apparatus of claim 1 wherein said inlet for adding said superheated steam is downstream of said centrifugal separator.

14. The apparatus of claim 1 wherein said collecting means communicates with a line to said flash drum for recycling said droplets and said coalesced additional previously supersaturated residue liquid to said flash/separation drum.

15. The apparatus of claim 6 wherein said cooling tube comprises an outlet for exhausting said heat exchange medium within said centrifugal separator.

16. The apparatus of claim 6 wherein said cooling tube comprises an outlet for exhausting said heat exchange medium outside said centrifugal separator.

* * * * *